US006443172B2

(12) United States Patent
Brumfield

(10) Patent No.: US 6,443,172 B2
(45) Date of Patent: Sep. 3, 2002

(54) BEACH UMBRELLA WITH SELF-SUPPORTING STAND

(76) Inventor: Donald U. Brumfield, 6206 Cahalan Ave., San Jose, CA (US) 95123

( * ) Notice: Subject to any disclaimer, the term of this patent is extended or adjusted under 35 U.S.C. 154(b) by 10 days.

(21) Appl. No.: 09/758,580

(22) Filed: Jan. 10, 2001

Related U.S. Application Data

(60) Provisional application No. 60/179,554, filed on Feb. 1, 2000.

(51) Int. Cl.[7] ..... A45B 11/00; A45F 3/44

(52) U.S. Cl. ..... 135/16; 248/533; 248/539

(58) Field of Search ..... 135/15.1, 16, 19, 135/20.1; 248/530, 533, 539, 511

(56) References Cited

U.S. PATENT DOCUMENTS

| | | | | | |
|---|---|---|---|---|---|
| 2,533,322 | A | * | 12/1950 | Kober | 135/16 |
| 2,759,486 | A | * | 8/1956 | Pesaturo | 135/16 |
| 3,434,484 | A | | 3/1969 | Dilullo | 135/16 |
| 4,249,715 | A | | 2/1981 | Repp | 248/545 |
| 4,524,533 | A | | 6/1985 | Still, Jr. | 40/607 |
| 4,832,163 | A | | 5/1989 | Levesque | 190/11 |
| 4,832,304 | A | | 5/1989 | Morgulis | 248/533 |
| 4,836,231 | A | * | 6/1989 | Peterson | 135/20.1 |
| 5,046,699 | A | * | 9/1991 | Perreault et al. | 135/16 |
| 5,143,108 | A | | 9/1992 | Kenney | 135/16 |
| 5,390,685 | A | * | 2/1995 | McCoy | 135/19 |
| 5,396,916 | A | * | 3/1995 | Boissonnault | 135/19 |
| 5,502,910 | A | | 4/1996 | Lucchesi | 40/606 |
| 5,878,762 | A | * | 3/1999 | Huang | 135/16 |

* cited by examiner

*Primary Examiner*—Michael Safavi
(74) *Attorney, Agent, or Firm*—Thomas Schneck; Gina McCarthy

(57) ABSTRACT

A beach umbrella is supported with a stand having a lower shaft and an upper shaft, with the upper shaft supporting a beach umbrella mast. Before attaching the umbrella mast, the tubular upper shaft serves as an impact tool against a protuberance on the lower shaft, allowing hammering of the lower shaft into composite earth. The upper shaft telescopes onto the lower shaft securing a tray in place against the protuberance after hammering is completed.

20 Claims, 4 Drawing Sheets

BEACH UMBRELLA WITH SELF-SUPPORTING STAND

CROSS-REFERENCE TO RELATED APPLICATION

This application claims the benefit of U.S. provisional application Ser. No. 60/179,554 filed Feb. 1, 2000.

TECHNICAL FIELD

The invention relates to a beach umbrella or the like, with means to facilitate ground insertion.

BACKGROUND ART

In U.S. Pat. No. 5,502,910, F. Lucchesi, describes a real estate sign pole which features a vertical pipe having a pointed bottom end which can be pounded into the ground with a special telescoping pounder tool. For installation of the sign pole, the pounder tool is moved emphatically up and down forcing the pole into the ground. The pounder tool is removed and an upper portion of a real estate sign is mounted at the top of the sign pole.

In U.S. Pat. No. 4,832,304, A. Morgulis, discloses a ground anchoring device for a pole which can support a beach umbrella. The anchoring device is an upright shaft, with a lower portion having screw threads. A handle at the top of the shaft allows rotation so that the shaft behaves as an earth auger, penetrating packed soil. Once the shaft is anchored into the ground, the upper portion of a beach umbrella may be joined to the shaft.

U.S. Pat. No. 5,143,108 to R. Kenney features a portable beach umbrella which may be securely placed by a storage cabinet having a central aperture through which the umbrella pole may pass. The cabinet provides stability for the umbrella. U.S. Pat. No. 4,832,163 to K. Levesque shows a beach umbrella which is supported by a pair of picnic baskets having the shape of split cylinder halves.

U.S. Pat. No. 3,434,484 to L. Dilullo features a beach umbrella with an upright pole having a circular tray mounted at approximately tabletop height, relative to the earth. The tray acts as a holder for convenience items, such as beverage containers and cups.

In U.S. Pat. No. 4,524,533, S. Still, discloses a real estate sign having a pointed post carrying a fixed disk near its top end. A driver tool consists of a pipe which fits over the tool and a reciprocating sleeve weight which moves up and down on the pipe, hammering on the disk associated with the pole. Once the pole is driven to a desired depth, the pipe and sleeve are removed and replaced by a real estate sign. The driver pipe has no further function.

An object of the invention was to devise a beach umbrella which could be easily driven into various composites of earth, having the functionality of an article of furniture for carrying cups and other food items, yet being easy to carry, assemble and store.

SUMMARY OF THE INVENTION

The above object has been achieved with a beach umbrella construction featuring a support stand with a shaft which can be driven into the earth by an impact tool which secures the umbrella support stand in place. The shaft has a lower portion with a tip adapted to be driven into various composites of earth and an upper portion with a protuberance, such as a flange, fixed a distance from the upper end. The impact tool may be a second shaft, fitting over the first shaft in a telescoping relationship allowing sliding of the second shaft over the first shaft as far as the protuberance. The protuberance acts as a stop, allowing the impact tool to hammer the first shaft securing it into the earth. After the impact tool has been used, it is removed from the first shaft. A tray is then mounted over the first shaft and supported by the protuberance. The impact tool or second shaft is then placed over the first shaft, securing the tray in place, with cup holders permanently attached to the impact tool. Finally, a beach umbrella is joined to the impact tool, completing the assembly with the impact tool integrated into the umbrella assembly.

BEST MODE FOR CARRYING OUT THE INVENTION

Figure 1:
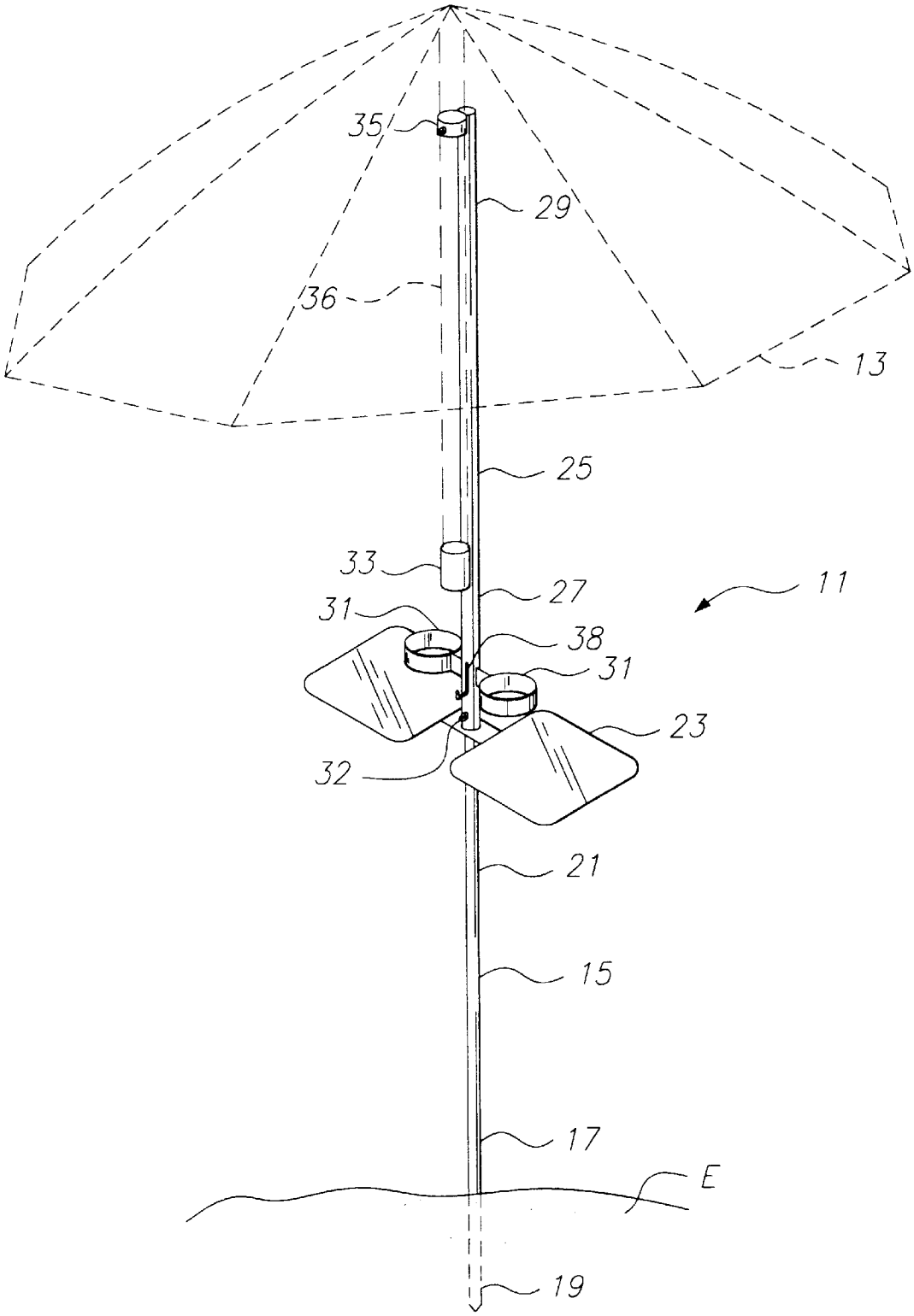
FIG. 1 is a perspective view of the apparatus of the present invention.

With reference to FIG. 1, an umbrella stand 11 is shown with an umbrella 13 affixed to the stand. The umbrella may be a beach umbrella or a sun umbrella. An important need is to stabilize the umbrella against wind, since the umbrella forms a type of sail which exerts considerable force against its stand. Using the present invention, the umbrella stand 11 is securely anchored in earth E.

The umbrella 13 is supported by a first shaft 15 having a lower portion 17 with a pointed bottom 19. The pointed bottom may be a sharpened tip or an open tube. The first shaft 15 is typically a steel or an aluminum shaft. For a steel shaft, a ⅝th inch solid, hot rolled steel shaft could be used. For an aluminum shaft having a diameter in the range of 1.5–3 inches is preferred. The wall thickness for an aluminum shaft is typically between 1/16th and ⅛th inch. These dimensions and materials are exemplary.

The upper portion 21 of first shaft 15 has a protuberance, not shown in FIG. 1. Upon this protuberance, a tray 23 is seated and above the first shaft 15, a second shaft 25 holds the tray 23 in place upon the protuberance. The second shaft 25, being an open pipe, larger in inner diameter than the outer diameter of the first shaft, serves as an impact tool for pounding the first shaft 15 into the earth. The second shaft could be a one inch outer diameter steel pipe if used with the ⅝th inch steel first shaft. In the case of an aluminum first shaft, the second shaft should have a recommended ⅜th inch larger outer diameter. Later, after installation of the first shaft 15, the tray is seated upon the protuberance and the second shaft 25 is mounted to overlap a few inches of the first shaft 15, in a telescoping relationship. The extent of overlap is dependent upon the location of the protuberance, typically 4–18 inches from the uppermost extent of the first shaft 15. For the steel shaft, a ⅝th inch washer is welded to the pipe but is not seen in FIG. 1.

The second shaft 25 has cup holders 31 directly mounted to the shaft. These holders are metallic loops which may or may not be closed at the bottom. For cups having tapered side walls, i.e. a frusto-conical shape, no bottom wall is needed. However, to retain cans and cups having cylindrical walls, a bottom wall would be provided. On opposing sides, at right angles to the cups, two hooks 38 may be provided. These hooks are used for attaching objects or clothing.

The second shaft 25 also carries umbrella supports. In particular, lower mast support 33 is mounted above the cup holders and upper mast support 35 is mounted at the uppermost portion 29 of the second shaft 25. The upper mast support 35 is a metal loop slightly larger in diameter than umbrella mast 36. The bottom of the mast 36 is mounted within the lower mast support 33, which has a closed bottom. The lower mast support 33 has a cup-like shape of a size for snugly accommodating the diameter of the umbrella mast 36.

Figure 2:
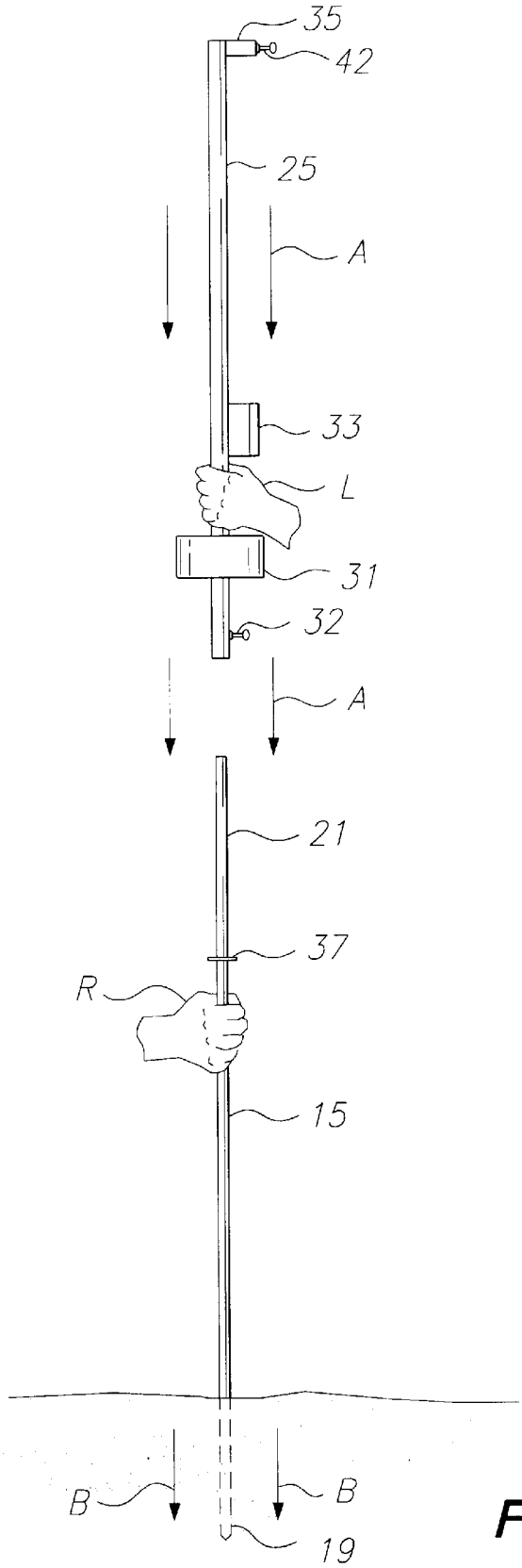
FIG. 2 is an operational view showing placement of a first shaft in composite earth by hammering with an impact tool or second shaft for setting up the apparatus shown in FIG. 1.

In FIG. 2 the right hand R, is seen to be holding the first shaft 15 securely in place immediately below the protuberance 37, seen to be a disk or washer. This disc is secured to first shaft 15 by means of welding, brazing or other secure connection. Rather than supplying a second part, the protuberance may be formed as an integral annular boss during the shaft extrusion process or associated with the process. The upper portion 21 of the shaft is intended to guide impact blows by the second shaft 25 hammering downwardly onto protuberance 37 as indicated by arrows A. The second shaft 25 need not be removed from the first shaft 15, but need only be raised several inches above the protuberance 37 in order to avoid any difficulties in achieving a telescoping relationship between the two shafts. The separation shown in FIG. 2 is merely for purposes of clearly showing all components. The upper shaft is held by the left hand L above the cup holders 31 and below the lower mast support 33. As downward force is emphatically applied, the pointed bottom 19 of first shaft 15 will be driven into the earth as indicated by the arrows B.

Figure 3:
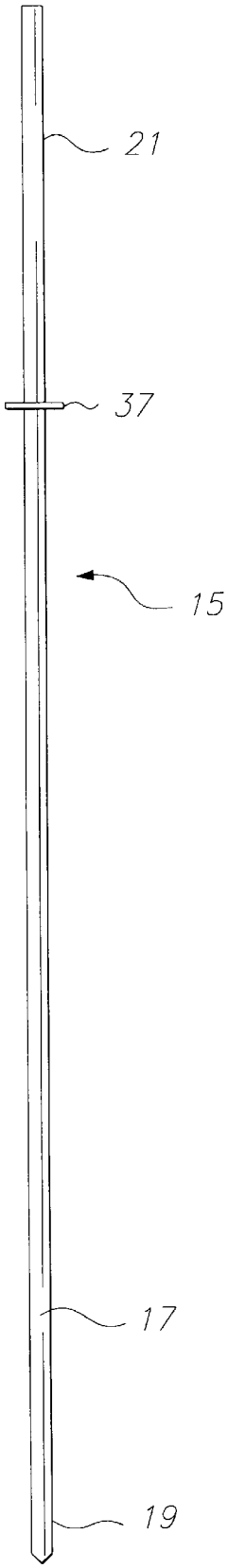
FIG. 3 is a side view of the first shaft shown in FIG. 1.

In FIG. 3, the first shaft 15 is seen in detail with protuberance 37 having only a small diameter, perhaps greater than the diameter of the first shaft 15, by an inch or two. The protuberance should not deform under impact and should be securely joined to first shaft 15 in order to avoid injury to a hand as impacts are delivered to the protuberance. The pointed bottom 19 is seen to be a closed structure, although the first shaft 15 could also be open and without a point. In this situation, earth would be free to move into the center of the first shaft. A pointed tip is preferred so that earth need not be removed from the center of the shaft on subsequent installations of the support.

Figure 4:
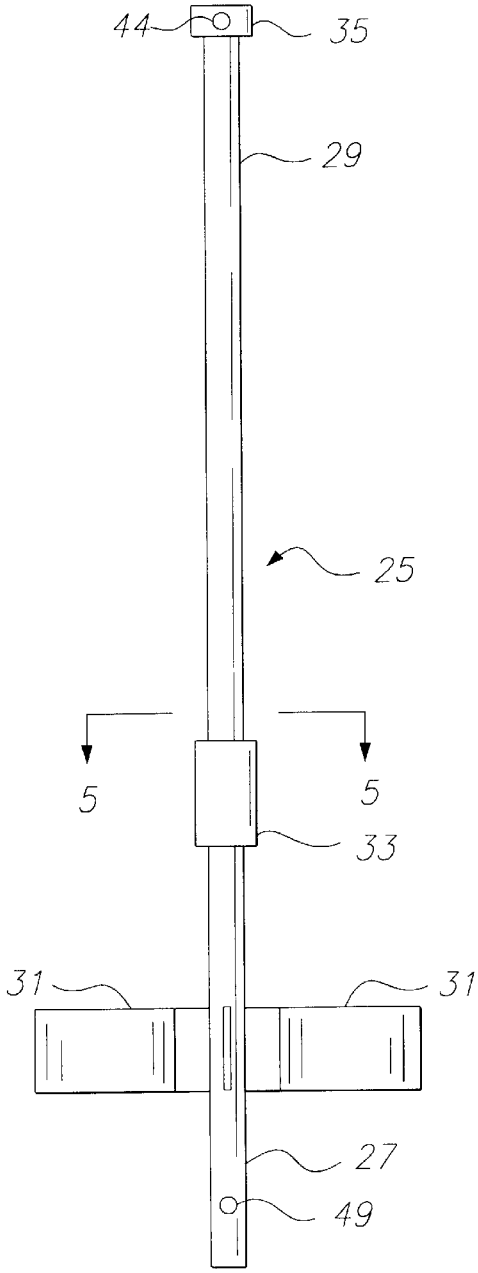
FIG. 4 is a side view of the impact tool or second shaft shown in FIG. 1.

In FIG. 4, the second shaft 25 has a larger diameter than the first shaft 15, but is otherwise made of similar material. The diameter of the second shaft 25 is only slightly larger than the outer diameter of the first shaft 15, allowing the second shaft 25 to reside in a telescoping manner, overlapping the upper portion 21 of the first shaft 15. A hole 49 having a threaded nut over it, not shown, receives a thumb screw associated with first shaft 15.

It might be possible for the second shaft to have a smaller diameter than the first shaft, with the protuberance formed internally within the first shaft. However, because of manufacturing expense considerations, it is preferable to have the protuberance 37 on the outside of the first shaft, requiring the outside diameter of the second shaft to be greater than the diameter of the first shaft. The cup holders 31 are seen to be on opposite sides of second shaft 25, providing balance. At a 90° angle to the cup holders, the lower and upper mast supports 33 and 35 are fixed to the second shaft. A hole 38 may be provided for seating a locking screw once the first shaft is driven into position and other members are installed. Similarly, a hole 44 may be provided in upper mast support 35 to secure the umbrella mast in position.

Figure 5:
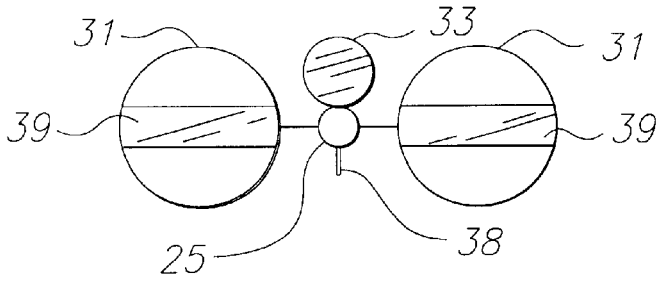
FIG. 5 is a top view of the impact tool or second shaft taken along lines 5—5 in FIG. 4.

In the top view of FIG. 5, the cup holders 31 are seen to have cup holder base members 39 as strips of metal running across the bottom of the cup holders. This makes these cup holders adapted for holding beverage cans and similar items. The lower mast support 33 has a bottom wall for supporting an umbrella mast. The second shaft 25 is seen to have a hook 38 for attaching objects.

Figure 6:
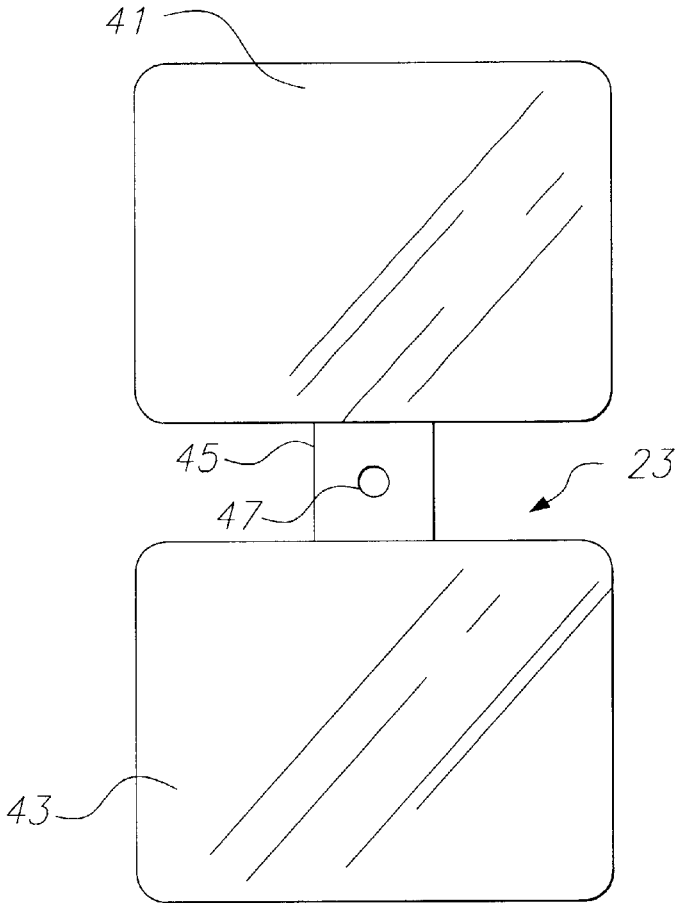
FIG. 6 is a top view of a tray of the type shown in FIG. 1.

In FIG. 6, tray 23 is seen to have a first tray 41 separated from a second tray 43 by means of a support handle 45, approximately two inches in width and ⅛th inch thick. The two trays 41 and 43 are approximately 12 inches×9 inches each, preferably made of 16-gauge cold rolled steel, and would support a plate or common food utensils. A central aperture 47 and support handle 45 is of a diameter which will allow the support handle 45 to pass over the first shaft 15 until it reaches the protuberance 37 where the handle resides. Once the tray 23 is in place, the second shaft can be placed over the first shaft and secured in place by a locking screw 32 in FIG. 5. When the first and second shafts have been assembled, with the tray 23 in place, the umbrella mast 36 may be slid into the upper and lower mast supports. The locking screw 32 then holds the umbrella mast in place and the umbrella 13 can be deployed by unfolding the umbrella, as shown in FIG. 1.

What is claimed is:

1. A beach umbrella with a self-supporting stand comprising, a shaft with upper and lower portions, the lower portion having a free end adapted for entry into composite earth and an opposite end having a protuberance spaced a distance from said opposite end, a tray having an aperture slightly larger than a characteristic cross-sectional dimension of the upper portion of the shaft and smaller than the protuberance whereby the tray rests on the protuberance, an impact tool having tubular construction and cross-sectional dimensions allowing sliding of the tool over the upper portion of the shaft as far as the protuberance, in a telescoping relation therewith, the protuberance having dimensions sufficiently great to stop an impact of the impact tool accelerating onto the shaft when driven by a significant force, and a beach umbrella joinable to the impact tool.

2. The apparatus of claim 1 wherein said protuberance is an annular flange.

3. The apparatus of claim 1 wherein said protuberance is a boss formed on the first shaft.

4. The apparatus of claim 1 wherein said protuberance is a member welded to the first shaft.

5. A beach umbrella with a self-supporting stand comprising, a first shaft having upper and lower portions, the upper portion having an end with an exterior protuberance spaced a distance from the shaft end in the range of 4–18 inches, with a characteristic cross-sectional dimension along said range, a second shaft having upper and lower portions, with a tubular construction and cross-sectional dimensions of the lower portion slideable over the characteristic cross-sectional dimension of the upper portion of the first shaft as far as the protuberance, in a telescoping relation therewith, the protuberance having dimensions sufficiently great to stop an impact of the second shaft accelerating onto the first shaft when driven by a significant force, the upper portion of the second shaft supporting a beach umbrella, and a pair of spaced apart tubular sleeves mounted on the second shaft, the sleeves defining a single common axis and having a diameter accommodating a shaft of the beach umbrella.

6. A beach umbrella with a self-supporting stand comprising, a first shaft having upper and lower portions, the upper portion having an end with an exterior protuberance spaced a distance from the shaft end in the range of 4–18 inches, with a characteristic cross-sectional dimension along said range, a tray having an aperture slightly larger than the characteristic cross-sectional dimension of the upper portion of the first shaft and smaller than the protuberance whereby the tray rests on the protuberance, and a second shaft having upper and lower portions, with a tubular construction and cross-sectional dimensions of the lower portion slideable over the characteristic cross-sectional dimension of the upper portion of the first shaft as far as the protuberance, in a telescoping relation therewith, the protuberance having dimensions sufficiently great to stop an impact of the second shaft accelerating onto the first shaft when driven by a significant force, the upper portion of the second shaft supporting a beach umbrella.

7. The apparatus of claim 6 wherein said protuberance is an annular flange.

8. The apparatus of claim 6 wherein said protuberance is a member welded to the first shaft.

9. The apparatus of claim 6 wherein said tray is fan shaped with a handle portion and an expanded portion, the handle portion having an aperture slightly larger than the characteristic cross-sectional dimension of the upper portion of the first shaft and smaller than the protuberance whereby the tray rests on the protuberance.

10. The apparatus of claim 6 further defined by said tray having a shape of two opposed fans, each with a handle portion and an expanded portion, the handle portions being joined, the joined handles having a central aperture slightly larger than the characteristic cross-sectional dimension of the upper portion of the first shaft and smaller than the protuberance whereby the tray rests on the protuberance whereby the opposed fans are in a balanced relation about the first shaft.

11. The apparatus of claim 6 further defined by a pair of spaced apart tubular sleeves mounted on the second shaft, the sleeves defining a single common axis and having a diameter accommodating a shaft of a beach umbrella.

12. The apparatus of claim 6 further defined by cup holders attached to the second shaft.

13. The apparatus of claim 6 further defined by hooks attached to the second shaft.

14. The apparatus of claim 6 wherein said protuberance is a boss formed on the first shaft.

15. A beach umbrella with a self-supporting stand comprising, a first shaft having upper and lower portions, the upper portion having an end with an exterior protuberance spaced a distance from the shaft end in the range of 4–18 inches, with a characteristic cross-sectional dimension along said range, wherein said protuberance is a member welded to the first shaft, and a second shaft having upper and lower portions, with a tubular construction and cross-sectional dimensions of the lower portion slideable over the characteristic cross-sectional dimension of the upper portion of the first shaft as far as the protuberance, in a telescoping relation therewith, the protuberance having dimensions sufficiently great to stop an impact of the second shaft accelerating onto the first shaft when driven by a significant force, the upper portion of the second shaft supporting a beach umbrella.

16. A method for setup of a beach umbrella comprising, placing a lower portion of a first shaft into composite earth, the first shaft having an upper portion with a protuberance extending upwardly above the earth, driving said first shaft further into the earth by applying downward force onto the protuberance using a tool fitting over the upper portion of the first shaft in a telescoping relation, mounting an umbrella upon an upper portion of the tool, and providing a tray on the first shaft after the first shaft is driven into the earth but before the umbrella is mounted in place.

17. The method of claim 16 wherein driving of the first shaft into the composite earth is done by emphatically hammering upon said protuberance with the tool.

18. The method of claim 16 wherein driving of the first shaft into the composite earth is done by using a second shaft as the tool and applying emphatic hammering action by the second shaft onto the first shaft.

19. The method of claim 16 wherein the tray is mounted on the first shaft by providing an aperture in the tray and placing the tray upon the protuberance.

20. A beach umbrella with a self-supporting stand comprising, a shaft with upper and lower portions, the lower portion having a free end adapted for entry into composite earth and an opposite end having a protuberance spaced a distance from said opposite end, wherein said protuberance is a member welded to the first shaft, an impact tool having tubular construction and cross-sectional dimensions allowing sliding of the tool over the upper portion of the shaft as far as the protuberance, in a telescoping relation therewith, the protuberance having dimensions sufficiently great to stop an impact of the impact tool accelerating onto the shaft when driven by a significant force, and a beach umbrella joinable to the impact tool.

* * * * *